US011486273B2

(12) United States Patent
Wang et al.

(10) Patent No.: US 11,486,273 B2
(45) Date of Patent: Nov. 1, 2022

(54) VARIABLE VALVE DRIVING MECHANISM OF ENGINE, AND ENGINE

(71) Applicant: WEICHAI POWER CO., LTD., Shandong (CN)

(72) Inventors: Fei Wang, Weifang (CN); Cheng Xu, Weifang (CN); Zhongsheng Ren, Weifang (CN); Baojun Wang, Weifang (CN); Deshi Xu, Weifang (CN); Gang Wang, Weifang (CN)

(73) Assignee: WEICHAI POWER CO., LTD., Weifang (CN)

( * ) Notice: Subject to any disclaimer, the term of this patent is extended or adjusted under 35 U.S.C. 154(b) by 0 days.

(21) Appl. No.: 17/419,258

(22) PCT Filed: Dec. 29, 2018

(86) PCT No.: PCT/CN2018/125442

§ 371 (c)(1),
(2) Date: Jun. 28, 2021

(87) PCT Pub. No.: WO2020/133382

PCT Pub. Date: Jul. 2, 2020

(65) Prior Publication Data

US 2022/0074320 A1 Mar. 10, 2022

(51) Int. Cl.
*F01L 1/18* (2006.01)
*F01L 1/22* (2006.01)
(Continued)

(52) U.S. Cl.
CPC ..... *F01L 1/18* (2013.01); *F01L 1/181* (2013.01); *F01L 1/22* (2013.01); *F01L 1/24* (2013.01);
(Continued)

(58) Field of Classification Search
CPC ... F01L 1/053; F01L 1/181; F01L 1/24; F01L 1/46; F01L 13/0036; F01L 2013/0089
(Continued)

(56) References Cited

U.S. PATENT DOCUMENTS 7,712,449 B1 * 5/2010 Schwoerer ..... F02D 13/04 123/90.15
2005/0274341 A1 12/2005 Usko
(Continued)

FOREIGN PATENT DOCUMENTS

CN 1985072 A 6/2007
CN 101457678 A 6/2009
(Continued)

OTHER PUBLICATIONS

PCT International Search Report and Written Opinion, PCT/CN2018/125442, dated Sep. 11, 2019, 10 pgs.

*Primary Examiner* — Jorge L Leon, Jr.
(74) *Attorney, Agent, or Firm* — Fenwick & West LLP

(57) ABSTRACT

A variable valve driving mechanism of an engine includes a rocker arm configured to control open and close of a valve and a servo rocker arm arranged in parallel to the rocker arm. A swing end of the servo rocker arm extends to the top of the swing end of the rocker arm. A valve adjustment gap provided in the swing direction of the servo rocker arm and the rocker arm is formed between the servo rocker arm and the rocker arm. A gap compensating device telescopically filling the valve adjustment gap and configured to adjust the valve to be delayed to close or open in advance when extending to the valve adjustment gap is provided between the servo rocker arm and the rocker arm.

8 Claims, 9 Drawing Sheets

(51) Int. Cl.

| | |
|---|---|
| ***F01L 1/46*** | (2006.01) |
| ***F01L 1/24*** | (2006.01) |
| ***F01L 13/00*** | (2006.01) |
| *F01L 1/053* | (2006.01) |

(52) U.S. Cl.
CPC ..... *F01L 1/46* (2013.01); *F01L 13/0036* (2013.01); *F01L 1/053* (2013.01); *F01L 2013/0089* (2013.01)

(58) Field of Classification Search
USPC ..... 123/90.16, 90.27, 90.44, 90.46
See application file for complete search history.

(56) References Cited

U.S. PATENT DOCUMENTS

| | | | | |
|---|---|---|---|---|
| 2006/0005796 | A1* | 1/2006 | Janak | F01L 1/181 123/90.39 |
| 2019/0107011 | A1* | 4/2019 | Contarin | F01L 13/065 |
| 2019/0178113 | A1* | 6/2019 | McCarthy, Jr. | F01L 1/181 |
| 2020/0182103 | A1* | 6/2020 | Mandell | F01L 13/065 |

FOREIGN PATENT DOCUMENTS

| | | | | |
|---|---|---|---|---|
| CN | 102966391 | A | | 3/2013 |
| CN | 103912336 | A | * | 7/2014 |
| CN | 103912336 | A | | 7/2014 |
| CN | 108331629 | A | | 7/2018 |

* cited by examiner

VARIABLE VALVE DRIVING MECHANISM OF ENGINE, AND ENGINE

FIELD

The present application is a 35 U.S.C 371 Patent Application of PCT Application No. PCT/CN2018/125442, filed on Dec. 29, 2018, which is hereby incorporated by reference in its entirety.

The present application relates to the field of engine technology, and in particular to an engine variable valve driving mechanism and an engine.

BACKGROUND

An engine variable valve driving mechanism in conventional technology is mainly composed of a rocker arm including a servo piston, a hydraulic gap adjustment device and other components, a cam follower cooperated with the servo piston and a solenoid valve. The rocker arm and the followers are nested on a rocker arm shaft and are rotatable relative to the rocker arm shaft, and the solenoid valve includes multiple oil filling and oil draining passages.

A camshaft includes two cams with different lifts, which adapts for different engine working conditions. Each of the two cams has a cam follower, which transmits the lift of the cam to the corresponding servo piston mounted in the rocker arm. Two servo pistons are provided in the rocker arm, the oil passages of the solenoid valve are controlled so that one servo piston is in an oil-filled state, and the other servo piston is in an oil-drained state. A gap is present between the servo piston in the oil-drained state and the cam follower, which can compensate for a cam lift of the cam follower. The servo piston in the oil-filled state extends out due to the oil filling, which eliminates the gap and can transmit the cam lift of the cam follower to the rocker arm, and finally transfer the lift to the valve through the hydraulic gap adjustment device, so as to control the movement of the valve. The solenoid valve is a multi-way valve with a one-way valve structure, which can prevent high-pressure oil from flowing back when the cam follower pushes the oil-filled servo piston and generates high-pressure oil backflow, and further prevent the lift loss of the valve.

In the existing valve lift structure, a conflict is present between the hydraulic gap adjustment device and the servo piston mechanism, so there is a risk that the valve cannot be closed; in addition, the solenoid valve prevents high-pressure oil from flowing back, which cannot eliminate the influence of oil pressure fluctuations between cylinders.

In summary, how to solve the problem of an incomplete valve closing caused by the use of multiple control oil passages has become an urgent technical problem for those skilled in the art.

SUMMARY

An engine variable valve driving mechanism is provided according to the embodiments of the present application, so as to solve the problem of an incomplete valve closing caused by the use of multiple control oil passages. An engine is further provided according to the present application.

In view of this, an engine variable valve driving mechanism according to the present application includes a rocker arm for controlling opening or closing of a valve and a servo rocker arm arranged in parallel to the rocker arm. A swing end of the servo rocker arm extends to a top of a swing end of the rocker arm, and a valve adjustment gap in a swing direction of the servo rocker arm and the rocker arm is present between the servo rocker arm and the rocker arm. A gap compensating device for telescopically filling the valve adjustment gap and adjusting the valve to be delayed to close or open in advance when the gap compensating device extending into the valve adjustment gap is provided between the servo rocker arm and the rocker arm.

Preferably, the gap compensating device includes a press block arranged at the swing end of the servo rocker arm and a plunger ejection structure arranged at the swing end of the rocker arm for abutting and cooperating with the press block.

Preferably, in the above engine variable valve driving mechanism, the plunger ejection structure is arranged on one side in a width direction of the rocker arm, and is arranged close to an adjustment screw of the rocker arm.

Preferably, in the above engine variable valve driving mechanism, the plunger ejection structure includes a plunger cavity arranged on the rocker arm, an ejector rod slidably extending out of or retracting into the plunger cavity, and a plunger located in the plunger cavity for dragging the ejector rod.

Preferably, in the above engine variable valve driving mechanism, an open end of the plunger cavity is provided with a cover plate for sealing the plunger cavity, and an ejector rod extend-retract hole is defined on the cover plate for being in sliding fit with an extending end of the ejector rod.

Preferably, in the above engine variable valve driving mechanism, the ejector rod includes an extending portion for being in sliding fit with the ejector rod extend-retract hole, and a guiding portion for being in sliding fit with an inner wall of the plunger cavity, an outer circumference of the extending portion is mounted with an ejector rod spring, and an ejector rod step abutting against the ejector rod spring is provided between the extending portion and the guiding portion.

Preferably, in the above engine variable valve driving mechanism, a pushing end of the plunger abuts against the guiding portion of the ejector rod, and a control oil passage is defined in a shaft hole of the rocker arm for communicating with the plunger cavity and a driving end of the plunger.

Preferably, in the above engine variable valve driving mechanism, the plunger cavity is further provided with an ejector rod limiting structure for limiting an extending length of the ejector rod.

Preferably, in the above engine variable valve driving mechanism, the ejector rod limiting structure includes a plunger hole located in the guiding portion and coaxially arranged with the ejector rod, and the plunger is slidably arranged in the plunger hole; a plunger return spring for pushing the plunger to an initial position is provided at a bottom of the plunger hole and in front of the plunger; a control pin extending hole for communicating the plunger hole to the plunger cavity is defined in a radial direction of the ejector rod, a control pin for ejecting and cooperating with the plunger is arranged in the control pin extending hole, and a limiting annular groove for being stuck with the control pin is defined in an inner wall of the plunger cavity.

Preferably, in the above engine variable valve driving mechanism, two ends of the control pin in an extending direction are arc limiting surfaces, and a pushing inclined surface for pushing and cooperating with the control pin is provided on the plunger.

Preferably, the above engine variable valve driving mechanism includes a rocker arm cam mounted on the rocker arm and a servo rocker arm cam mounted on the servo rocker arm arranged on a closing side of the valve. A maximum lift of the servo rocker arm cam is not larger than a maximum lift of the rocker arm cam, and the servo rocker arm cam closes later than the rocker arm cam.

Preferably, in the above engine variable valve driving mechanism, a switching zone of the servo rocker arm cam and the rocker arm cam is located in a lift falling zone of the servo rocker arm cam and the rocker arm cam, and a lift falling speed of the servo rocker arm cam is smaller than a lift falling speed of the rocker arm cam.

Preferably, the above engine variable valve driving mechanism includes a rocker arm cam mounted on the rocker arm and a servo rocker arm cam mounted on the servo rocker arm arranged on an opening side of the valve. A maximum lift of the servo rocker arm cam is not larger than a maximum lift of the rocker arm cam, and the servo rocker arm cam opens earlier than the rocker arm cam.

An engine includes a camshaft and a valve rocker arm which is mounted on the camshaft to control opening or closing of a valve. The valve rocker arm includes the engine variable valve driving mechanism according to any one of the above.

Preferably, the above engine includes a spring bracket arranged in an axial direction of the camshaft is mounted above the valve rocker arm, and a servo rocker arm spring driving the servo rocker arm to swing is mounted between the spring bracket and the servo rocker arm.

The engine variable valve driving mechanism provided according to the present application includes the rocker arm for controlling the opening or closing of the valve and the servo rocker arm arranged in parallel to the rocker arm. The swing end of the servo rocker arm extends to the top of the swing end of the rocker arm. The valve adjustment gap in the swing direction of the servo rocker arm and the rocker arm is present between the servo rocker arm and the rocker arm. The gap compensating device for telescopically filling the valve adjustment gap and adjusting the valve to be delayed to close or open in advance when the gap compensating device extending to the valve adjustment gap is provided between the servo rocker arm and the rocker arm. The rocker arm swings to control opening or closing of the valve, and the servo rocker arm arranged in parallel extends to the top of the swing end of the rocker arm, and the gap compensating device is present between the rocker arm and the servo rocker arm. When the valve is opened or closed normally, the swing ends of the rocker arm and the servo rocker arm are provided with the gap compensating device, and the gap compensating device is retracted, and the rocker arm is not in contact with the servo rocker arm in the swing process by means of the valve adjustment gap. When the valve is required to control to be delayed to close or open in advance, the gap compensating device extends into the valve adjustment gap, so that the swing ends of the servo rocker arm and the rocker arm abuts against the gap compensating device to eliminate the gap, and the rocker arm is controlled by the servo rocker arm to control the late closing or early opening of the valve in the swing process. The gap compensating device with the telescopic structure adjusts the valve adjustment gap between the servo rocker arm and the rocker arm, which realizes late closing or early opening of the valve. The servo rocker arm and the gap compensating device are used at the same time to avoid the problem of an incomplete valve closing caused by the use of multiple control oil passages.

Figure 1:
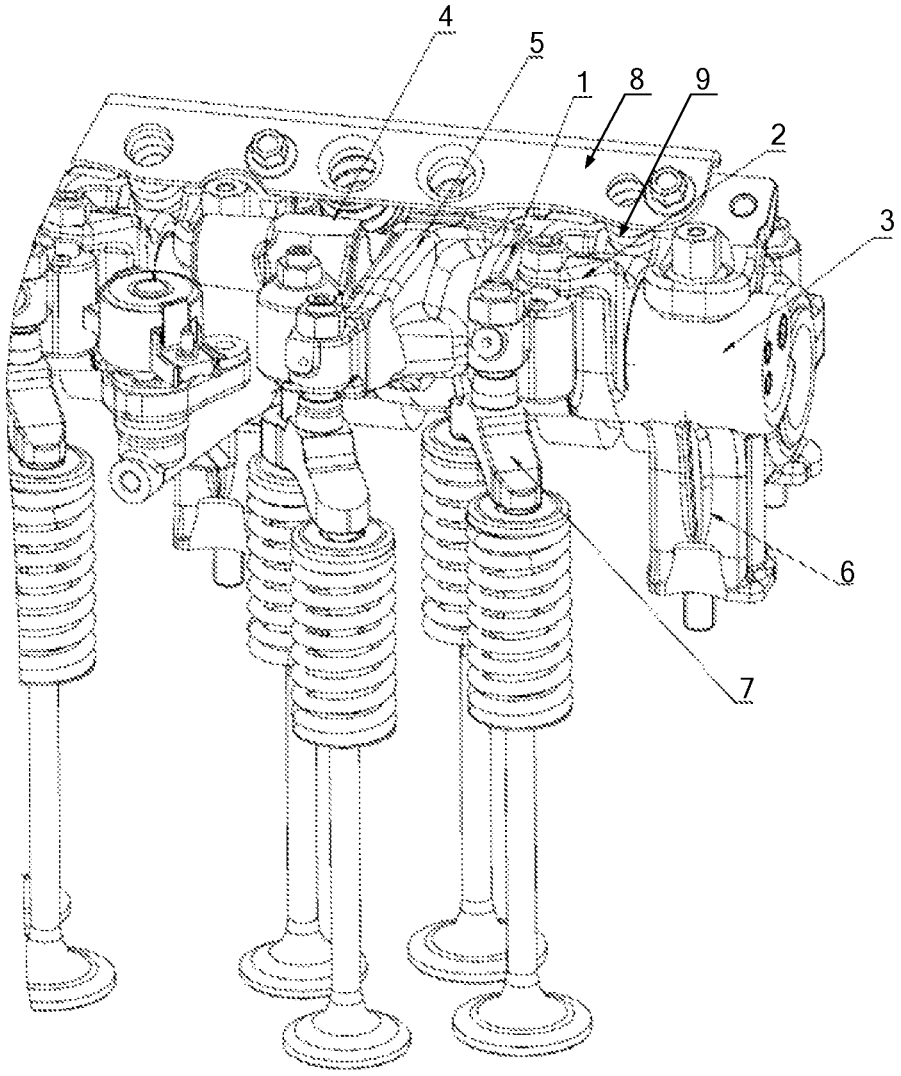
FIG. 1 is an assembly diagram of an engine variable valve driving mechanism provided according to the present application.

| The reference numerals in FIGS. 1 to 15 are: | |
|---|---|
| 1 rocker arm, | 2 servo rocker arm, |
| 3 rocker arm shaft, | 4 solenoid valve; |
| 5 valve rocker arm, | 6 camshaft seat, |
| 7 valve, | 8 spring bracket, |
| 9 servo rocker arm spring, | 10 plunger ejection rod, |
| 11 ejector rod, | 12 cover plate screw, |
| 13 cover plate, | 14 ejector rod spring, |
| 15 control pin, | 151 control pin extending hole, |
| 16 plunger return spring, | 17 plunger; |
| 18 plunger cavity, | 19 control oil passage, |
| 20 press block, | 110 plunger hole, |
| 101 limiting annular groove, | 1-2 valve adjustment gap, |
| 11-2 servo rocker arm cam, | 11-1 rocker arm cam. |

DETAILED DESCRIPTION OF THE EMBODIMENTS

A core of the present application is to provide an engine variable valve driving mechanism, which solves the problem of an incomplete valve closing caused by the use of multiple control oil passages. An engine is further provided according to the present application.

In order to enable those skilled in the art to better understand the technical solutions of the present application, the present application will be further described in detail below with reference to the drawings and embodiments.

Figure 2:
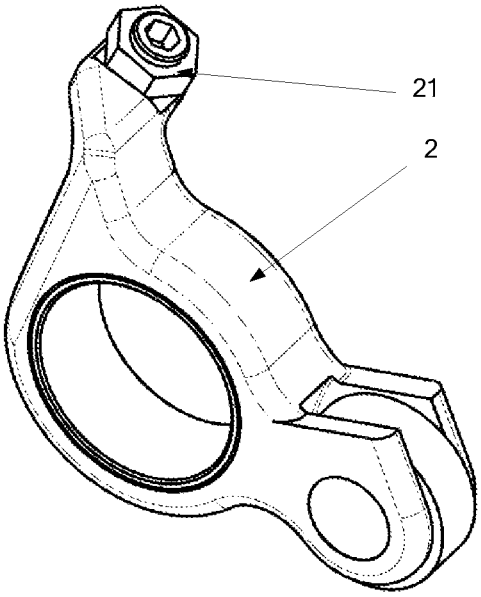
FIG. 2 is a first direction structural view of a servo rocker arm in the engine variable valve driving mechanism provided according to the present application.
Figure 3:
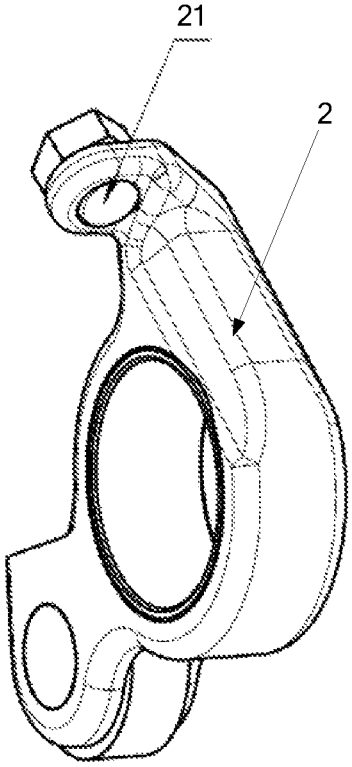
FIG. 3 is a second direction structural view of the servo rocker arm in the engine variable valve driving mechanism provided according to the present application.
Figure 4:
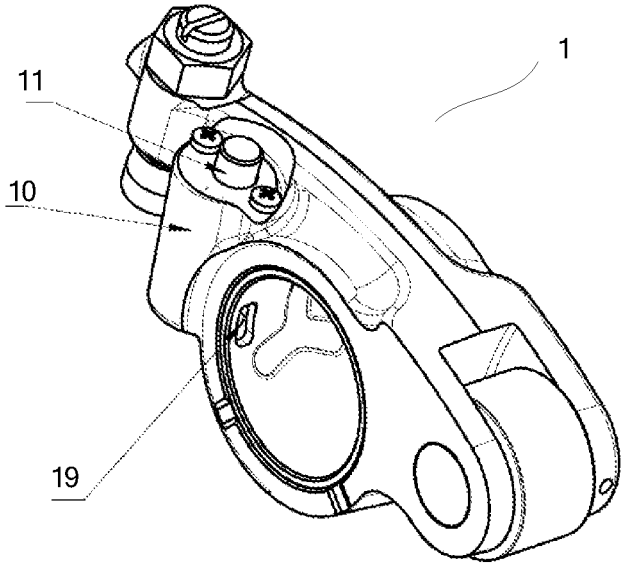
FIG. 4 is a schematic structural diagram of a rocker arm in the engine variable valve driving mechanism provided according to the present application.
Figure 5:
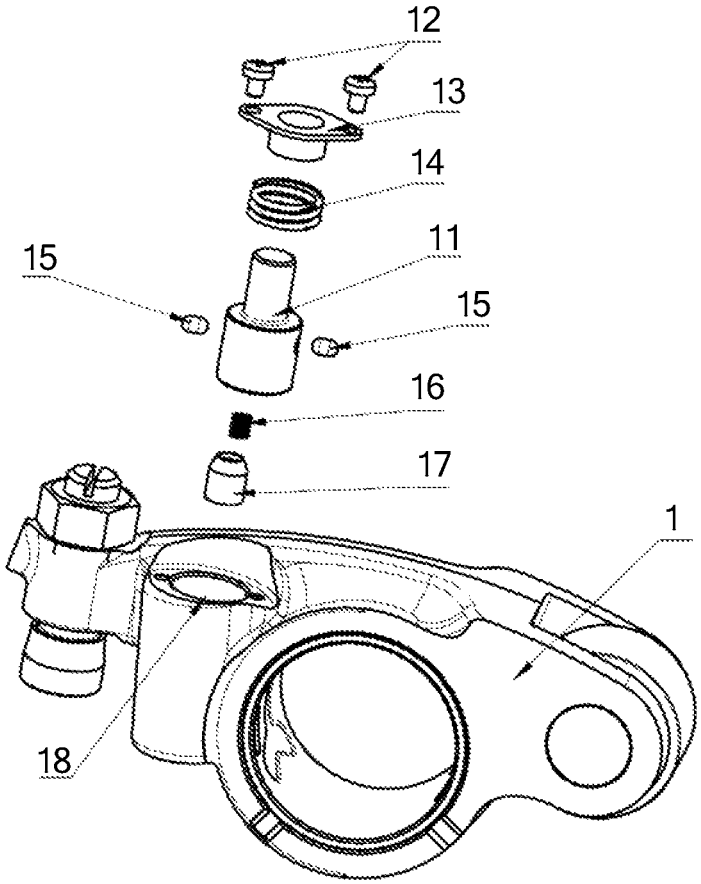
FIG. 5 is an exploded schematic structural diagram of FIG. 4.
Figure 6:
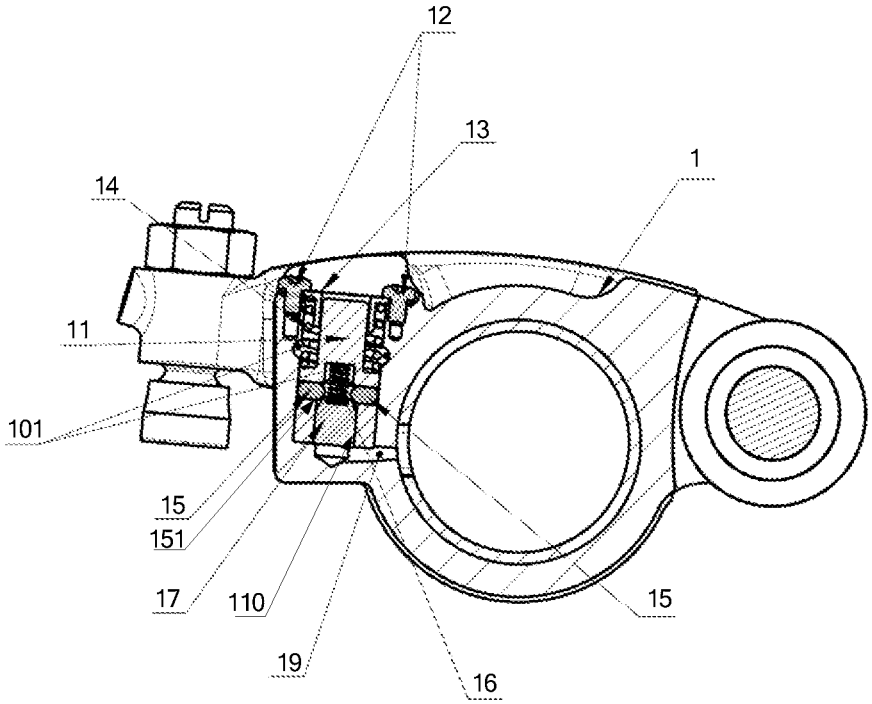
FIG. 6 is a structural sectional view of retracting an ejector rod of the rocker arm in FIG. 5.

As shown in FIGS. 1 to 5, FIG. 1 is an assembly diagram of an engine variable valve driving mechanism provided according to the present application; FIG. 2 is a first direction structural view of a servo rocker arm in the engine variable valve driving mechanism provided according to the present application; FIG. 3 is a second direction structural view of the servo rocker arm in the engine variable valve driving mechanism provided according to the present application; FIG. 4 is a schematic structural diagram of a rocker arm in the engine variable valve driving mechanism provided according to the present application; FIG. 5 is an exploded schematic structural diagram of the rocker arm in FIG. 4.

An engine variable valve driving mechanism provided according to the present application includes a rocker arm 1 configured to control opening or closing of a valve and a servo rocker arm 2 arranged in parallel to the rocker arm 1. A swing end of the servo rocker arm 2 extends to a top of a swing end of the rocker arm 1, and a valve adjustment gap 1-2 in a swing direction of the servo rocker arm 2 and the rocker arm 1 is present between the servo rocker arm 2 and the rocker arm 1. A gap compensating device is provided between the servo rocker arm 2 and the rocker arm 1, and the gap compensating device is telescopically filled in the valve adjustment gap 1-2 and is configured to adjust the valve 7 to be delayed to close or open in advance when the gap compensating device extending into the valve adjustment gap 1-2.

The rocker arm 1 swings to control opening and closing of the valve 7, and the servo rocker arm 2 arranged in parallel extends to the top of the swing end of the rocker arm 1, and the gap compensating device is provided between the rocker arm 1 and the servo rocker arm 2. When the valve 7 is opened or closed normally, the swing ends of the rocker arm 1 and the servo rocker arm 2 present the valve adjustment gap 1-2, and the gap compensating device is retracted, and the rocker arm 1 is not in contact with the servo rocker arm 2 in the swing process by means of the valve adjustment gap. When the valve 7 is required to control to be delayed to close or open in advance, the gap compensating device extends into the valve adjustment gap, so that the swing ends of the servo rocker arm 2 and the rocker arm 1 abuts against the gap compensating device to eliminate the valve adjustment gap 1-2, and the rocker arm 1 is controlled by the servo rocker arm 2 to control the valve 7 to be delayed to close or advanced to open in the swing process. The gap compensating device with a telescopic structure can adjust the valve adjustment gap between the servo rocker arm 2 and the rocker arm 1, which realizes late closing or early opening of the valve 7. At the same time, since the servo rocker arm and the gap compensating device are used for realizing valve adjustment, the problem of an incomplete valve closing caused by the use of multiple control oil passages can be avoided. The valve adjustment gap is eliminated by the servo rocker arm, the gap compensating device and the rocker arm, thus, for the working condition where the valve is delayed to close, the rocker arm is pressed by the servo rocker arm, and the opening time of the valve is delayed by the gap compensating device, so as to realize the valve to be delayed to close.

For the working condition where the valve is opened in advance, the rocker arm is pressed by the servo rocker arm through the gap compensating device to open the valve during the normal opening time of the valve, so as to realize opening the valve in advance.

In a specific embodiment of the present application, the gap compensating device comprises a press block 21 arranged at the swing end of the servo rocker arm 2 and a plunger ejection structure 10 arranged at the swing end of the rocker arm 1, and the plunger ejection structure 10 abuts against and cooperates with the press block 21. The press block 21 is arranged at the swing end of the servo rocker arm 2, the plunger ejection structure 10 is arranged at the swing end of the rocker arm 1, and the plunger ejection structure 10 cooperates with the press block 21 during the extension and retraction process to eliminate the valve adjustment gap between the rocker arm 1 and the servo rocker arm 2.

Certainly, the press block 21 and the plunger ejection structure 10 may also be arranged at the rocker arm 1 and the servo rocker arm 2 respectively due to the limitation of the swing space between the rocker arm 1 and the servo rocker arm 2 in the engine.

Figure 7:
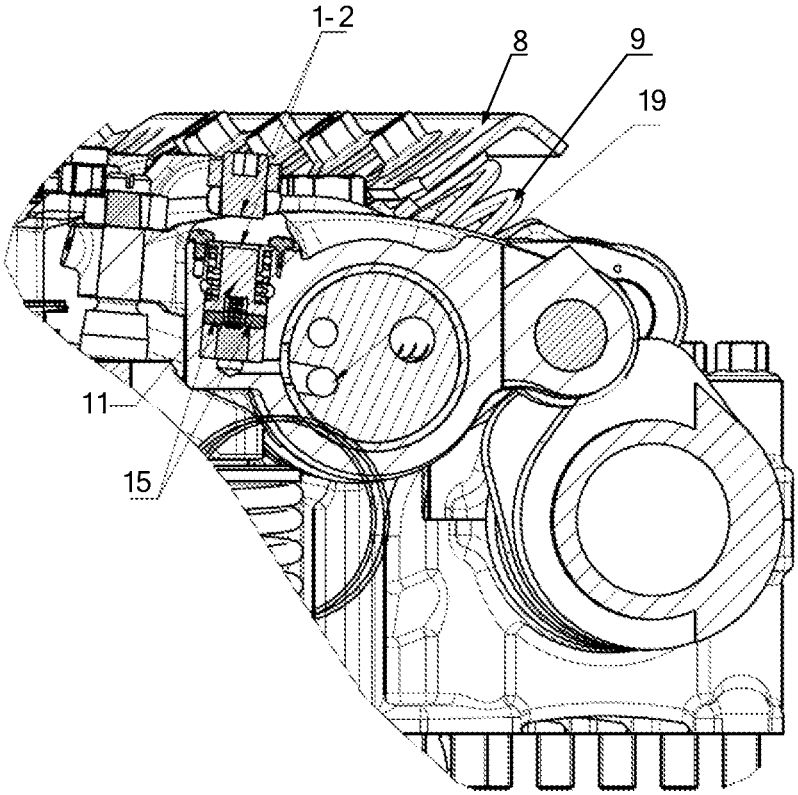
FIG. 7 is a schematic structural diagram of a retracting position of the ejector rod and a press block in the engine variable valve driving mechanism provided according to the present application.
Figure 8:
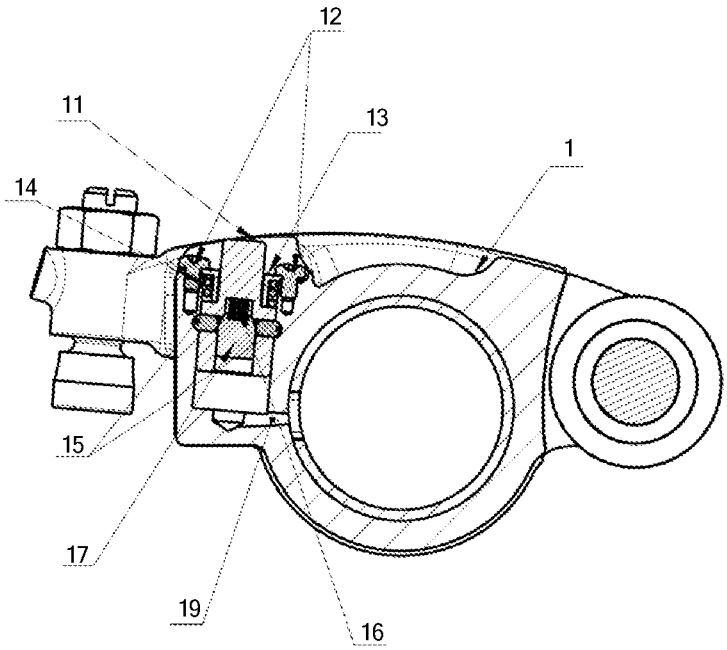
FIG. 8 is a schematic structural diagram of extending the ejector rod of the rocker arm in FIG. 5.
Figure 9:
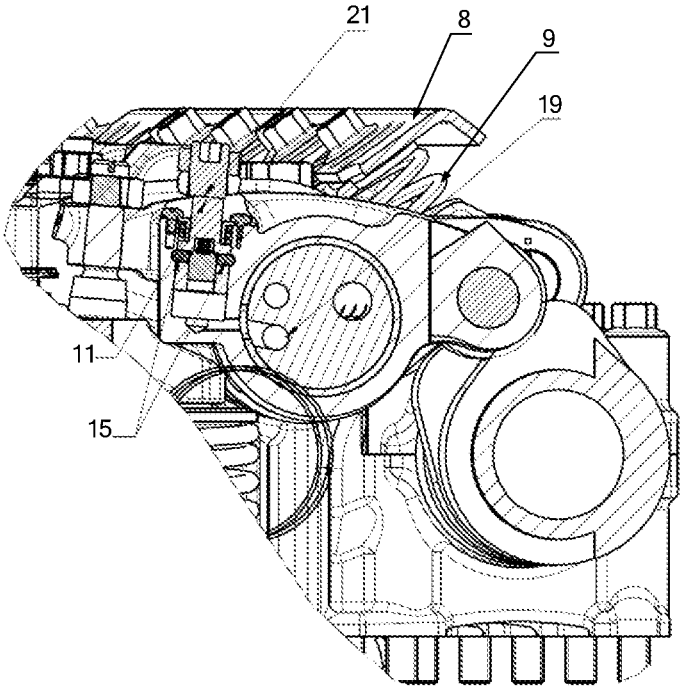
FIG. 9 is a schematic structural diagram of an extending position of the ejector rod and the press block in the engine variable valve driving mechanism provided according to the present application.

As shown in FIGS. 6 to 9, FIG. 6 is a structural sectional view of retracting an ejector rod of the rocker arm in FIG. 5; FIG. 7 is a schematic structural diagram of a retracting position of the ejector rod and the press block in the engine variable valve driving mechanism provided according to the present application; FIG. 8 is a schematic structural diagram of extending the ejector rod of the rocker arm in FIG. 5; FIG. 9 is a schematic structural diagram of an extending position of the ejector rod and the press block in the engine variable valve driving mechanism provided according to the present application.

In a specific embodiment of the present application, the plunger ejection structure 10 is arranged on one side in a width direction of the rocker arm 1, and is arranged close to an adjustment screw of the rocker arm 1. The position of the plunger ejection structure 10 should avoid affecting the swing of the rocker arm 1. The plunger ejection structure 10 is arranged on one side of the width direction of the rocker arm 1, and is close to the adjustment screw of the rocker arm 1, and the adjustment screw of the rocker arm 1 is configured to support the ejector rod of the valve, so it has a space for arranging the plunger ejection structure. Moreover, the rocker arm 1 is arranged in parallel to the servo rocker arm 2, the position of the servo rocker arm 2 is arranged in parallel to ends of multiple valve rocker arms 5, so as to avoid the opening and closing adjustment of the valve of the rocker arm 1.

Specifically, the plunger ejection structure 10 includes a plunger cavity 18 arranged on the rocker arm 1, an ejector rod 11 slidably extending out of or retracting into the plunger cavity 18, and a plunger 17 located in the plunger cavity 18 for dragging the ejector rod to act. The plunger 17 is slidably arranged in the plunger cavity 18, the ejector rod is dragged to extend out of or fall back into the plunger cavity 18 during the sliding process of the plunger 17. The ejector rod 11 abuts against the press block 21 on the servo rocker arm 2 after extending out of the plunger cavity 18, which eliminates the valve adjustment gap and control the valve 7 to be delayed to close. After the ejector rod 11 retracts and falls back into the plunger cavity 18, the valve gap between the servo rocker arm 2 and the rocker arm 1 is present. At this time, a gap is always present between the swing of the rocker arm 1 and the servo rocker arm 2, and the servo rocker arm 2 does not affect the swing of the rocker arm 1, thus, the valve 7 opens and closes normally.

In a specific embodiment of the present application, an open end of the plunger cavity 18 is provided with a cover plate 13 for sealing the plunger cavity 18, and an ejector rod extend-retract hole is defined on the cover plate 13 to be in sliding fit with an extending end of the ejector rod 11. The open end of the plunger cavity 18 is defined upwards, and the opening of the plunger cavity 18 is covered by the cover plate 13. The plunger cavity 18 is sealed by the cover plate 13 after the ejector rod 11 is mounted from a top of the plunger cavity 18. The ejector rod extend-retract hole is defined on the cover plate 13, the ejector rod 11 is slidable and extendable in the ejector rod extend-retract hole, and the ejector rod 11 is in sliding fit with the ejector rod extend-retract hole, so as to ensure the sealing in the plunger cavity. Specifically, the cover plate 13 is fixedly mounted on the rocker arm 1 through a cover plate screw 12.

In a specific embodiment, the ejector rod 11 includes an extending portion for being in sliding fit with the ejector rod extend-retract hole, and a guiding portion for being in sliding fit with an inner wall of the plunger cavity 18, an outer circumference of the extending portion is mounted with an ejector rod spring 14, and an ejector rod step abutting against the ejector rod spring is provided between the extending portion and the guiding portion. The ejector rod 11 in the plunger cavity 18 is dragged by the plunger 17 to achieve sliding movement. In order to decrease the oil passages, the ejector rod 11 is returned by the ejector rod spring 14. The ejector rod spring 14 is composed of the extending portion and the guiding portion with different diameters. The guiding portion is in sliding fit with the inner wall of the plunger cavity, the ejector rod extend-retract hole of the cover plate 13 is in sliding fit with the extending portion of the ejector rod 11, the ejector rod step is formed between the extending portion and the guiding portion, the ejector rod spring 14 is mounted outside the extending portion, one end of the ejector rod spring 14 abuts against the ejector rod step, the other end of the ejector rod spring 14 abuts against a cover end of the cover plate 13. The ejector rod presses the ejector rod spring 14 tightly when the ejector rod 11 is extended, the plunger 17 drags the ejector rod 11 to act and compress the ejector rod spring 14 to deform, and the ejector rod 11 extends out of the cover plate 13. When the oil pressure on a side of the plunger 17 decrease, the ejector rod spring 14 returns and pushes the ejector rod to retract.

In a specific embodiment of the present application, a pushing end of the plunger 17 abuts against the guiding portion of the ejector rod 11, and a control oil passage 19 communicated with the plunger cavity 18 and a driving end of the plunger 17 is defined in a shaft hole of the rocker arm 1. The plunger 17 is located at one end of the guiding portion of the ejector rod 11, the control oil passage 19 is defined in the rocker arm 1, and the control oil passage 19 is communicated to the plunger cavity 18 via the shaft hole of the rocker arm 1. In order to ensure the communication of the oil passage of the control oil, a special oil passage communicated to the control oil passage 19 is defined in a rocker arm shaft 3, and the special oil passage is configured to supply normal control oil of the plunger ejection structure. In addition, the mounting structure of the rocker arm 1 is further provided with a solenoid valve 4, which is configured to control the supply of hydraulic oil in the control oil passage 19, so as to allow the plunger 17 to eject out the ejector rod 11. The rocker arm shaft 3 is supported by the rocker arm shaft and a camshaft seat 6, so as to ensure the stability of the valve structure.

The control oil passage 19 should be communicated to a bottom of the plunger cavity 18, and a control oil pressure directly presses against the driving end of the plunger 17, the driving end of the plunger 17 is pushed by the oil pressure and transmitted to the pushing end of the plunger 17, and the pushing end pushes the ejector rod 11 to extend.

In a specific embodiment of the present application, the plunger cavity 18 is further provided with an ejector rod limiting structure configured to limit an extending length of the ejector rod 11. The plunger ejection structure 10 abuts against the press block 21 on the servo rocker arm 2. As the valve 7 is opened or closed, the impact is transmitted to the plunger ejection structure 10, which further affects the oil pressure in the control oil passage 19. In order to ensure the stability of the ejection structure after the plunger ejection structure 10 is extended, the plunger cavity 18 is provided with the ejector rod limiting structure. After the ejector rod 11 is extended, the position of the ejector rod 11 is limited by the ejector rod limiting structure. After the oil pressure in the control oil passage 19 decreases, the ejector rod limiting structure retracts automatically in the process of the ejector rod 11 being ejected back by the ejector rod spring 14, so as to ensure the smooth retraction of the ejector rod.

In a specific embodiment of the present application, the ejector rod limiting structure includes a plunger hole 110 located in the guiding portion and coaxially arranged with the ejector rod 11, and the plunger 17 is slidably arranged in the plunger hole 110. When the plunger 17 slides in the plunger hole 110 of the guiding portion of the ejector rod, the control oil passage 19 inputs the control oil pressure and acts on the plunger 17 and an end of the guiding portion of the ejector rod at the same time, thus the plunger 17 is pushed so as to drag the ejector rod 11 to extend out of the plunger cavity 18.

A plunger return spring 16 for pushing the plunger 17 to an initial position is provided at a bottom of the plunger hole 110 and in front of the plunger 17. A plunger return spring 16 is further provided between the plunger 17 and the ejector rod 11. After the control oil pressure in the control oil passage 19 is eliminated, the ejector rod 11 is pushed by the ejector rod spring 14 to retract, and the plunger 17 is pushed to be returned by sliding in the plunger hole 110.

A control pin extending hole 151 for communicating the plunger hole 110 to the plunger cavity 18 is defined in the ejector rod 11 in a radial direction thereof, a control pin 15 for ejecting and cooperating with the plunger 17 is arranged in the control pin extending hole 151, and a limiting annular groove for being stuck by the control pin is defined in an inner wall of the plunger cavity 18. The ejector rod in the plunger hole has an annular structure, the control pin extending hole 151 is defined on a side wall of the ejector rod, and the control pin extending hole 151 communicates the inner wall of the plunger cavity 18 with an inner cavity of the plunger hole 110. The control pin extending hole 151 is provided with the control pin 15 therein, the limiting annular groove 101 is defined on the inner wall of the plunger cavity 18. When the ejector rod 11 is extended, the control pin 15 is ejected by the plunger 17 and is stuck in the limiting annular groove 101, so as to limit the ejector rod 11 after extending, and avoid the impact between the servo rocker arm 2 and the rocker arm 1 causing the ejector rod to fall back, and result in unstable opening and closing structure of the valve.

In a specific embodiment of the present application, two ends of the control pin 15 in an extending direction are arc limiting surfaces, and a pushing inclined surface for pushing the control pin 15 is provided on the plunger 17. The control pin 15 is pushed out by the extension of the plunger. When the ejector rod 11 falls back, the control pin 15 needs to be retracted into the control pin extending hole 151 to facilitate the ejector rod 11 to fall normally. Since the two ends of the control pin 15 in the extending direction are arc limiting surfaces, and an end of the plunger 17 abutting against the control pin 15 is the pushing inclined structure, and the control pin 15 is ejected out from the control pin extending hole 151 by the pushing inclined surface abutting against the control pin 15, after the control pin 15 is retracted into the control pin extending hole 151, the end, retracted into the control pin extending hole 151, of the control pin 15 abuts against the smallest diameter position of the plunger 17, which prevents the control pin 15 from contacting with the plunger return spring 16 and affects the normal extension and retraction of the control pin.

The special control oil passage 19 is defined in the rocker arm shaft 3, and the on-off of the oil passage is controlled by the solenoid valve 4. When the solenoid valve 4 is de-energized, the control oil passage 19 is not filled with oil, the plunger ejection structure 10 returns under the action of the spring, and the valve adjustment gap 1-2 is present between the rocker arm 1 and the servo rocker arm 2. A lift of the servo rocker arm 2 is not transmitted to the rocker arm 1, and the valve 7 opens or closes normally. When the solenoid valve 4 is energized, the control oil passage 19 is filled with oil, the control oil reaches the bottom of the plunger ejection structure 10 and pushes the plunger 17 and the ejector rod 11 upward together. When the ejector rod 11 reaches the maximum lift, the control pin extending hole 151 on the side surface is aligned with the control annular groove 101 in the plunger cavity 18. At this time, the control oil continues to push the plunger 17 upward, and the control pin 15 is pushed out of an inner hole of the ejector rod 11, the control pin 15 is extended and is connected with the control annular groove 101 in the plunger cavity 18 to form a locking mechanism. The ejector rod 11 is at the maximum lift position, the valve adjustment gap 1-2 between the rocker arm 1 and the servo rocker arm 2 has been eliminated, and the lift of the servo rocker arm 2 is transmitted to the rocker arm 1, so as to form a valve closing retard effect.

As shown in FIG. 7, the solenoid valve 4 is in the de-energized state, the plunger 17 is retracted, the lift of the servo rocker arm 2 is not transmitted to the rocker arm 1. As shown in FIG. 9, the solenoid valve 4 is in the energized state, the plunger 17 moves upward, and the lift of the servo rocker arm 2 is transmitted to the rocker arm 1 so as to form a valve closing retard.

Figure 10:
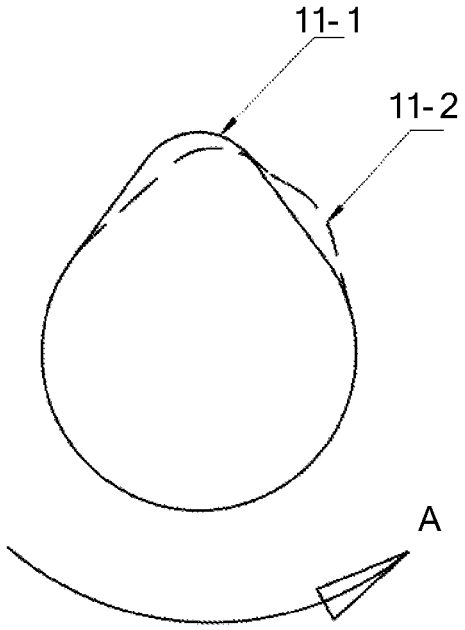
FIG. 10 is a schematic structural diagram of axial profiles of a rocker arm cam and a servo rocker arm cam.
Figure 11:
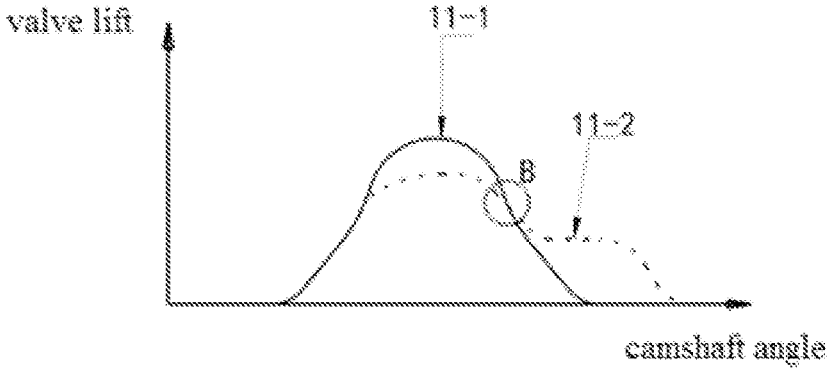
FIG. 11 is a valve lift diagram of late closing of a solenoid valve in a de-energized state.
Figure 12:
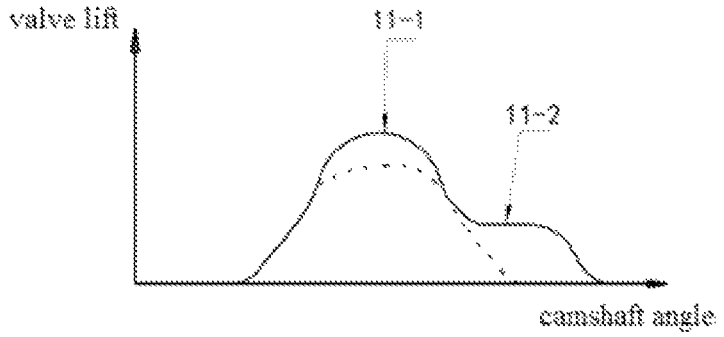
FIG. 12 is a valve lift diagram of late closing of the solenoid valve in an energized state.
Figure 13:
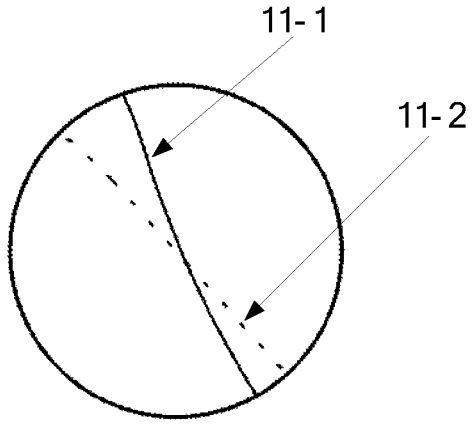
FIG. 13 is a partial enlarged view at location B in FIG. 11.

As shown in FIGS. 10 to 13, FIG. 10 is a schematic structural diagram of axial profiles of a rocker arm cam and a servo rocker arm cam; FIG. 11 is a valve lift diagram of late closing of a solenoid valve in a de-energized state; FIG. 12 is a valve lift diagram of late closing of the solenoid valve in an energized state; FIG. 13 is a partial enlarged view at location B in FIG. 11.

In a specific embodiment of the present application, the engine variable valve driving mechanism includes a rocker arm cam 11-1 mounted on the rocker arm 1 and a servo rocker arm cam 11-2 mounted on the servo rocker arm 2 arranged on a closing side of the valve 7. A maximum lift of the servo rocker arm cam 11-2 is not larger than a maximum lift of the rocker arm cam 11-1, and the servo rocker arm cam 11-2 closes later than the rocker arm cam 11-1.

As shown in FIG. 11, the solenoid valve 4 is in the de-energized state, the servo rocker arm 2 may not affect the swing of the rocker arm 1, and the valve lift changes with a camshaft angle along a solid line part. The maximum lift of the servo rocker arm cam 11-2 is not larger than the maximum lift of the rocker arm cam 11-1, so that when the solenoid valve 4 is disconnected, the valve is always present adjustment gap 1-2 between the servo rocker arm 2 and the rocker arm 1 after the ejector rod 11 retracts into the plunger cavity 18, which avoids the influence of the servo rocker arm 2 on the opening and closing of the valve 7 when the rocker arm is working normally.

As shown in FIG. 12, the solenoid valve 4 is in the energized state, the valve lift changes with a camshaft angle. The valve lift transitions to the lift of the servo rocker arm 2 from the lift of the rocker arm 1, and the valve realizes closing retard. When the ejector rod 11 is extended, the ejector rod 11 abuts against tightly with the press block 21 of the servo rocker arm 2, the valve adjustment gap 1-2 is eliminated, and the lift of the servo rocker arm 2 is transmitted to the rocker arm 1, so as to achieve closing retard. As shown in FIG. 10, a rotation direction of the rocker arm shaft rotates counterclockwise A. After the valve adjustment gap 1-2 is compensated, the lift of the valve 7 transitions to the dashed line lift of the servo rocker arm from the solid rocker arm cam stroke.

The servo rocker arm cam 11-2 closes later than the rocker arm cam 11-1. When the ejector rod 11 is extended to eliminate the valve adjustment gap 1-2, and the servo rocker arm 2 continues to press the rocker arm tightly and keeps the valve open after the rocker arm 1 passes through the maximum stroke, and the valve closes after the servo rocker arm passes through the maximum stroke of the servo rocker arm.

Due to the closing time difference between the servo rocker arm cam 11-2 and the rocker arm cam 11-1, the rocker arm cam 11-1 passes through its maximum stroke and is switched to the servo rocker arm cam 11-2, there may be an impact between the servo rocker arm cam 11-2 and the rocker arm cam 11-1. As shown in FIG. 13, the crankshaft angles of the servo rocker arm cam 11-2 and the rocker arm cam 11-1 in a switching position are located in a lift falling zone B, and the difference between the two crankshaft angles is controlled to be as small as possible to form a buffer structure. When the lift of the rocker arm cam 11-1 falls, the lift of the servo rocker arm cam 11-2 also falls, but a lift falling speed of the servo rocker arm cam is slightly lower than a lift falling speed of the rocker arm cam, until the lift of the servo rocker arm cam 11-2 exceeds the lift of the rocker arm cam 11-1, the switch is completed. In this way, it can be ensured that when the actual lift of the rocker arm 1 is switched from the rocker arm cam 11-1 to the servo rocker arm cam 11-2, the relative speed of the two rocker arms is small, which may reduce the impact risk of the switching of the rocker arms.

Figure 14:
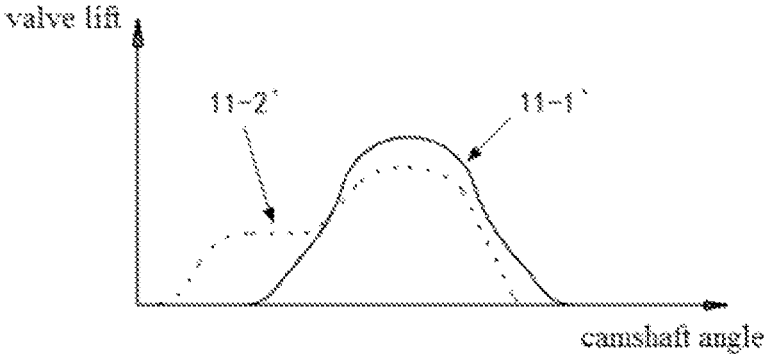
FIG. 14 is a valve lift diagram of early opening of the solenoid valve in a de-energized state.
Figure 15:
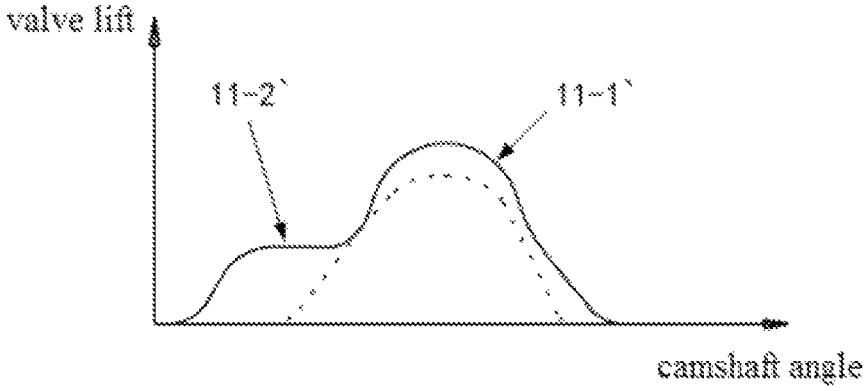
FIG. 15 is a valve lift diagram of early opening of the solenoid valve in an energized state.

As shown in FIGS. 14 and 15, FIG. 14 is a valve lift diagram of early opening of the solenoid valve in a de-energized state; FIG. 15 is a valve lift diagram of early opening of the solenoid valve in an energized state.

In a specific embodiment of the present application, the engine variable valve driving mechanism further includes a rocker arm cam 11-1' mounted on the rocker arm 1 and a servo rocker arm cam 11-2' mounted on the servo rocker arm 2 arranged on an opening side of the valve. A maximum lift of the servo rocker arm cam 11-2' is not larger than a maximum lift of the rocker arm cam 11-1', and the servo rocker arm cam 11-2' opens earlier than the rocker arm cam 11-1'.

As shown in FIGS. 14 and 15, the servo rocker arm cam 11-2' opens earlier than the rocker arm cam 11-1'. When the valve adjustment gap is not filled by the gap adjustment device, the swing of the rocker arm 1 is not affected by the servo rocker arm 2. At this time, the swing of the rocker arm 1 performs valve lift according to a camshaft angle of the rocker arm cam 11-1'. When the valve adjustment gap is filled by the gap adjustment device, the servo rocker arm 2 directly abuts against the rocker arm 1, and the rocker arm 1 changes with the camshaft angle, the valve lift moves in advance according to the valve lift of the servo rocker arm 1, so that the valve is opened in advance according to the lift curve of the servo rocker arm cam 11-2' and the lift curve of the rocker arm cam 11-1'.

Based on the engine variable valve driving mechanism provided according to the above embodiments, an engine provided according to the present application includes a camshaft 3 and a valve rocker arm 5 which is mounted on the camshaft 3 to control opening and closing of a valve 7. The valve rocker arm includes the engine variable valve driving structure as described in the above embodiments.

Since the engine provided according to the present application includes the engine variable valve driving structure, the beneficial effects of the engine brought by the engine variable valve driving structure may refer to the above embodiments.

In a specific embodiment of the present application, a spring bracket 8 arranged in an axial direction of the camshaft 3 is mounted above the valve rocker arm 5, and a servo rocker arm spring 9 driving the servo rocker arm 2 to swing is mounted between the spring bracket 8 and the servo rocker arm 2. In the working process of the rocker arm 1, a first swing end of the rocker arm 1 abuts against the valve 7, and the another end of the rocker arm 1 abuts against the camshaft, so as to control the opening and closing of the valve 7. However, the servo rocker arm 2 only abuts against the camshaft 3 at one end, and the other end of the servo rocker arm 2 is in a swinging state when there is a valve adjustment gap. The normal pressing of the servo rocker arm 2 on the rocker arm 1 is ensured by providing the spring bracket 8 above the valve rocker arm 5 and mounting the servo rocker arm spring 9 which provides a return force to the servo rocker arm 2.

It should be noted that, terms such as "include", "comprise" or any other variations thereof herein are intended to cover non-exclusive inclusion, so that an article or device including a series of elements not only includes those elements, but also includes other elements not explicitly listed, or elements inherent in such article or device. If there are no more restrictions, the elements defined by the sentence "include a . . . " does not exclude the existence of other same elements in the article or device which includes the above elements.

The principle and embodiments of the present application are described through specific examples herein. The description of the above-described embodiments is merely used to facilitate understanding the method and core idea of the present application. It should be noted that, for those skilled in the art, various improvements and modifications may be further made to the present disclosure without departing from the principle of the present disclosure, and these improvements and modifications also fall within the protection scope defined by the claims of the present disclosure.

The invention claimed is:

1. An engine variable valve driving mechanism, comprising:

a rocker arm configured to control opening and closing of a valve;

a servo rocker arm arranged in parallel to the rocker arm, the servo rocker arm including a swing end extending over a swing end of the rocker arm such that a valve adjustment gap is formed between the servo rocker arm and the rocker arm in a swing direction of the servo rocker arm and the rocker arm; and a gap compensating device configured to enable a late closing or an early opening of the valve when the gap compensating device selectively extends between the servo rocker arm and the rocker arm so as to close the valve adjustment gap, wherein the gap compensating device comprises a plunger ejection structure at the swing end of the rocker arm, the plunger ejection structure configured to engage a press block arranged at the swing end of the servo rocker arm, wherein the plunger ejection structure comprises a plunger cavity arranged on the rocker arm, an ejector rod configured to alternately extend out of and retract into the plunger cavity, and a plunger located in the plunger cavity, the plunger configured to engage the ejector rod, wherein an open end of the plunger cavity is provided with a cover plate configured to seal the plunger cavity, and the ejector rod slides through the cover plate via an ejector rod extend-retract hole defined on the cover plate, wherein the ejector rod comprises an extending portion configured to engage the ejector rod extend-retract hole, a guiding portion configured to engage an inner wall of the plunger cavity, an ejector rod step defined between the extending portion and the guiding portion, and an ejector rod spring arranged along an outer circumference of the extending portion and pressed between the ejector rod step and the cover plate, wherein a control oil passage is defined in a shaft hole of the rocker arm, the control oil passage configured to communicate with the plunger cavity, an upper end of the plunger abuts against the guiding portion, and a lower end of the plunger communicates with the control oil passage, wherein the plunger ejection structure further comprises an ejector rod limiting structure configured to limit an extending length of the ejector rod, wherein the ejector rod limiting structure comprises a plunger hole located in the guiding portion so as to be coaxially arranged with the ejector rod, the plunger hole configured to slidably receive the plunger, wherein the plunger hole comprises a plunger return spring arranged between the plunger and a bottom of the plunger hole, the plunger return spring configured to bias the plunger to an initial position;

wherein the ejector rod further comprises a radially extending control pin extending hole configured to connect the plunger hole to the plunger cavity, a control pin is arranged in the control pin extending hole, the control pin configured to engage a limiting annular groove defined in the inner wall of the plunger cavity when the control pin is actuated by the plunger.

2. The engine variable valve driving mechanism according to claim 1, wherein the plunger ejection structure is arranged on one side in a width direction of the rocker arm at a position adjacent to an adjustment screw of the rocker arm.

3. The engine variable valve driving mechanism according to claim 1, wherein the control pin comprises inner and outer longitudinal ends formed as arc limiting surfaces, and the upper end of the plunger is formed as an inclined surface so as to engage the inner longitudinal end of the control pin.

4. The engine variable valve driving mechanism according to claim 1, further comprising a rocker arm cam configured to actuate the rocker arm, and a servo rocker arm cam configured to actuate the servo rocker arm, wherein a maximum lift of the servo rocker arm cam is less than or equal to a maximum lift of the rocker arm cam, and a closing timing of the valve actuated by the servo rocker arm cam is later than a closing timing of the valve actuated by the rocker arm cam.

5. The engine variable valve driving mechanism according to claim 4, wherein a switching zone of the servo rocker arm cam and the rocker arm cam is located in a lift falling zone of the servo rocker arm cam and the rocker arm cam, and a lift falling speed of the servo rocker arm cam is less than a lift falling speed of the rocker arm cam.

6. The engine variable valve driving mechanism according to claim 1, further comprising a rocker arm cam configured to actuate the rocker arm and a servo rocker arm cam configured to actuate the servo rocker arm, wherein a maximum lift of the servo rocker arm cam is less than or equal to a maximum lift of the rocker arm cam, and an opening timing of the valve actuated by the servo rocker arm cam is earlier than an opening timing of the valve actuated by the rocker arm cam.

7. An engine, comprising a camshaft and the engine variable valve driving mechanism according to claim 1, wherein the camshaft is configured to actuate the rocker arm and the servo rocker arm.

8. The engine according to claim 7, further comprising a spring bracket arranged above the servo rocker arm so as to extend along an axial direction of the camshaft, and a servo rocker arm spring mounted between the spring bracket and the servo rocker arm so as to bias the servo rocker arm toward the camshaft.

* * * * *